US009261326B1

(12) United States Patent
Chandler

(10) Patent No.: US 9,261,326 B1
(45) Date of Patent: Feb. 16, 2016

(54) FIREARM DOCKING SYSTEMS

(71) Applicant: Neal W. Chandler, Bossier City, LA (US)

(72) Inventor: Neal W. Chandler, Bossier City, LA (US)

( * ) Notice: Subject to any disclaimer, the term of this patent is extended or adjusted under 35 U.S.C. 154(b) by 158 days.

(21) Appl. No.: 14/150,123

(22) Filed: Jan. 8, 2014

(51) Int. Cl.
*F41C 33/02* (2006.01)
*F41C 27/00* (2006.01)

(52) U.S. Cl.
CPC ..... *F41C 27/00* (2013.01)

(58) Field of Classification Search
CPC ..... F41C 27/00; F41C 33/02; F41C 33/0245; F41C 33/045
See application file for complete search history.

(56) References Cited

U.S. PATENT DOCUMENTS 3,300,109 A * 1/1967 Clark ..... 224/667
4,050,662 A 9/1977 Pickering
4,198,026 A 4/1980 Capolupo
4,299,045 A * 11/1981 Cervantes ..... 42/70.07
4,419,794 A * 12/1983 Horton et al. ..... 24/667
4,504,001 A * 3/1985 Nichols ..... 224/198
4,570,890 A 2/1986 Lohn
4,718,586 A * 1/1988 Hagino ..... 224/666
4,721,276 A * 1/1988 Moss ..... 248/311.2
4,929,116 A * 5/1990 Mahl ..... 403/263
5,054,170 A * 10/1991 Otrusina ..... 24/580.11
5,597,102 A * 1/1997 Saarikko et al. ..... 224/197
5,598,958 A * 2/1997 Ryan et al. ..... 224/198
5,630,535 A 5/1997 Valenti
5,850,996 A * 12/1998 Liang ..... 248/221.11
6,112,962 A * 9/2000 Matthews ..... 224/243
6,161,741 A * 12/2000 French ..... 224/198
6,389,726 B1 5/2002 Bentley
6,550,175 B2 * 4/2003 Parker ..... 42/70.07
6,685,067 B2 2/2004 French
6,726,072 B2 * 4/2004 Rugh ..... 224/269
9,097,479 B1 * 8/2015 Barido et al.

* cited by examiner

*Primary Examiner* — Brian D Nash
(74) *Attorney, Agent, or Firm* — R. Keith Harrison

(57) ABSTRACT

Firearm docking systems include a receiver bracket configured for attachment to a mounting structure, a bracket slot in the receiver bracket, an adaptor retaining mechanism carried by the receiver bracket adjacent to the bracket slot and a male adaptor configured for attachment to a firearm and including an adaptor flange inserted in the bracket slot. The adaptor flange is selectively rotatable in the bracket slot. A plurality of adaptor flange openings is provided in the adaptor flange. The adaptor retaining mechanism releasably engages at least one of the plurality of adaptor flange openings. The firearm can be mounted and rotated relative to the mounting structure by rotating the adaptor flange relative to the adaptor retaining mechanism in the bracket slot. Thus, the firearm can be both secure and ergonomically correct in an easily-retrievable position.

18 Claims, 13 Drawing Sheets

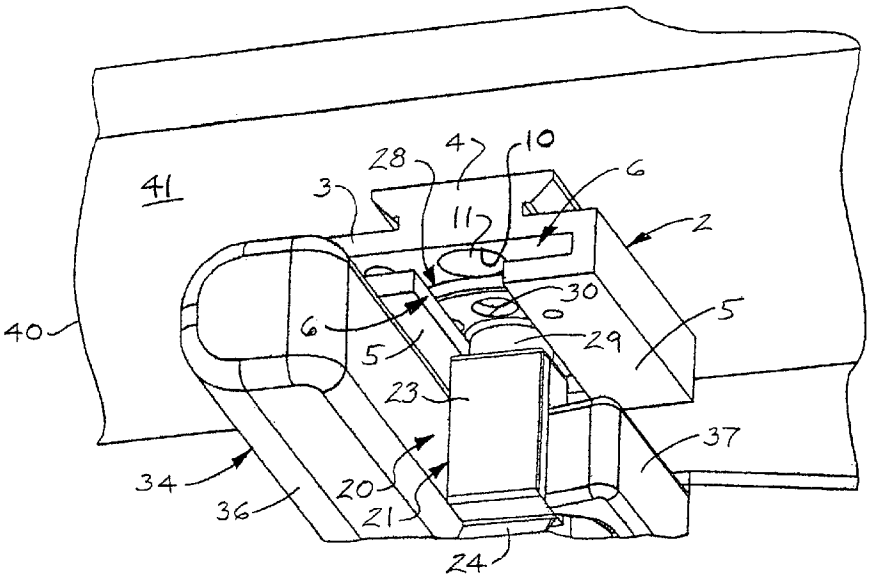
FIG. 6
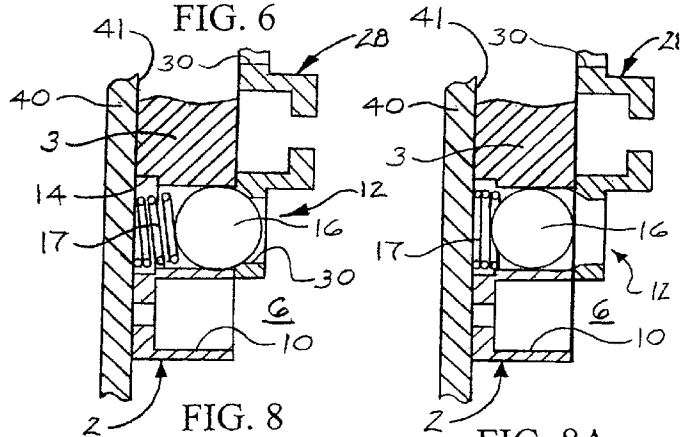
FIG. 8
FIG. 8A
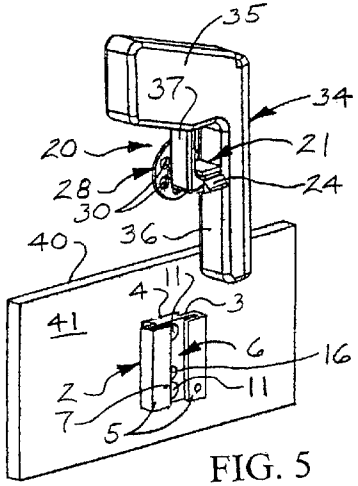
FIG. 5
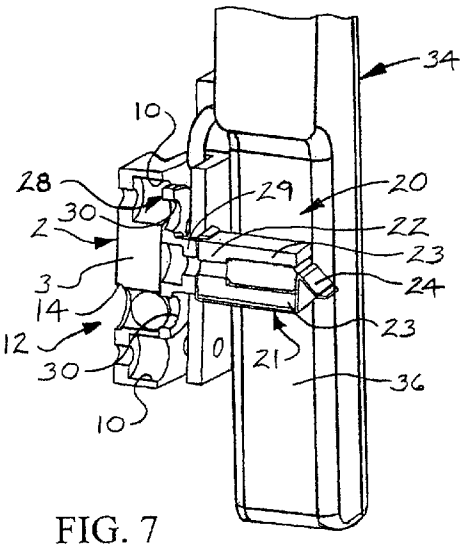
FIG. 7

FIREARM DOCKING SYSTEMS

FIELD

Illustrative embodiments of the disclosure relate to firearms. More particularly, illustrative embodiments of the disclosure relate to firearm docking systems which facilitate mounting of a firearm to a mounting structure so the firearm can be both secure and ergonomically correct in an easily-retrievable position.

BACKGROUND

The background description provided herein is solely for the purpose of generally presenting the context of the illustrative embodiments of the disclosure. Aspects of the background description are neither expressly nor impliedly admitted as prior art against the claimed subject matter.

Firearm users frequently maintain a pistol, rifle or other firearm in a ready-to-use position in a home, office, vehicle or other location in case use of the firearm is necessary for self-defense. Some firearm users may carry a firearm on their persons such as in a holster which may be worn on a belt around the waist or an ankle. In a home or office setting, a firearm may be kept in a drawer, cabinet or other space. In a vehicle, the firearm may be kept under a seat or in a glove box. Since it may not be secured in a particular location, however, the firearm may not be properly positioned for quick apprehension and use in the event that such use is necessary. Moreover, the firearm user does not develop muscle memory which would otherwise enable the user to quickly locate and retrieve the firearm each time use of the firearm is desired.

Therefore, firearm docking systems which facilitate mounting of a firearm to a mounting structure in an easily-retrievable position may be desirable for some applications. Additionally, an option of locking the firearm in the firearm docking system to prevent theft or child tampering of the firearm may also be desirable.

SUMMARY

Illustrative embodiments of the disclosure are generally directed to firearm docking systems which facilitate mounting of a firearm to a mounting structure in an easily-retrievable, repeatable and known position. The firearm docking systems may provide for safe, ergonomically-correct holding of a firearm in which substantial shock or force is required to dislodge the firearm. An illustrative embodiment of the firearm docking systems includes a receiver bracket: a bracket slot in the receiver bracket; an adaptor retaining mechanism carried by the receiver bracket adjacent to the bracket slot; and a male adaptor including an adaptor flange inserted in the bracket slot, the adaptor flange selectively rotatable in the bracket slot. A plurality of adaptor flange openings is provided in the adaptor flange, and the adaptor retaining mechanism releasably engages at least one of the plurality of adaptor flange openings. In some embodiments, the firearm may be selectively locked in the firearm docking system using a padlock or the like.

BRIEF DESCRIPTION OF THE DRAWINGS

Illustrative embodiments of the disclosure will now be described, by way of example, with reference to the accompanying drawings, in which:

FIG. 5 is an exploded perspective view illustrating retrievable mounting of the pistol on the support structure by inserting the male adaptor into the receiver bracket;

FIG. 6 is an enlarged sectional perspective view which details the male adaptor inserted in the receiver bracket in retrievable mounting of the pistol on the support structure;

FIG. 7 is a sectional perspective view which illustrates an exemplary adaptor retaining mechanism for fixing or retaining the male adaptor and attached pistol at a selected rotational position relative to the receiver bracket;

FIG. 8 is a sectional view of the exemplary adaptor retaining mechanism illustrated in FIG. 7, with a ball bearing of the adaptor retaining mechanism disposed in an adaptor retaining position;

FIG. 8A is a sectional view of the exemplary adaptor retaining mechanism illustrated in FIGS. 7 and 8, with the ball bearing disposed in an adaptor release position;

DETAILED DESCRIPTION

The following detailed description is merely exemplary in nature and is not intended to limit the described embodiments or the application and uses of the described embodiments. As used herein, the word "exemplary" or "illustrative" means "serving as an example, instance, or illustration." Any implementation described herein as "exemplary" or "illustrative" is not necessarily to be construed as preferred or advantageous over other implementations. All of the implementations described below are exemplary implementations provided to enable persons skilled in the art to practice the disclosure and are not intended to limit the scope of the claims. Moreover, the illustrative embodiments described herein are not exhaustive and embodiments or implementations other than those which are described herein and which fall within the scope of the appended claims are possible. Furthermore, there is no intention to be bound by any expressed or implied theory presented in the preceding technical field, background, brief summary or the following detailed description.

Figure 1:
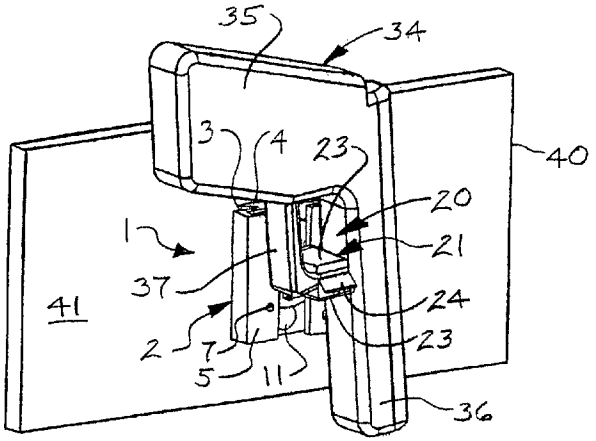
FIG. 1 is a perspective view of an illustrative embodiment of the firearm docking systems on a support structure, with the firearm docking system mounting a pistol in a retrievable position on the support structure.

Referring initially to FIGS. 1-8A of the drawings, an illustrative embodiment of the firearm docking systems is generally indicated by reference numeral 1. As illustrated in FIG. 1 and will be hereinafter further described, in exemplary application, the firearm docking system 1 is adapted to retrievably mount a firearm 34 on a mounting surface 41 of a mounting structure 40 in such a manner that a user of the firearm 34 can quickly, easily and conveniently retrieve the firearm 34. The mounting structure 40 may include any structure to which the firearm 34 is to be detachably mounted for convenient retrieval by the user of the firearm 34. Non-limiting examples of mounting structures 40 in various implementations of the firearm docking system 1 may include but are not limited to a desk, door, drawer, cabinet or vehicle dashboard. In some applications of the firearm docking system 1, the firearm 34 may be a pistol with a grip 35, a barrel 36 extending from the grip 35 and a trigger guard 37 extending between the grip 35 and the barrel 36. In other applications of the firearm docking system 1, the firearm 34 may be a rifle or any other short, intermediate or long gun.

Figure 3:
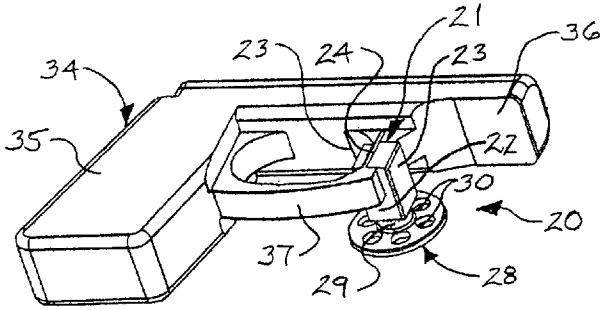
FIG. 3 is a perspective view with the exemplary male adaptor attached to the pistol.
Figure 4:
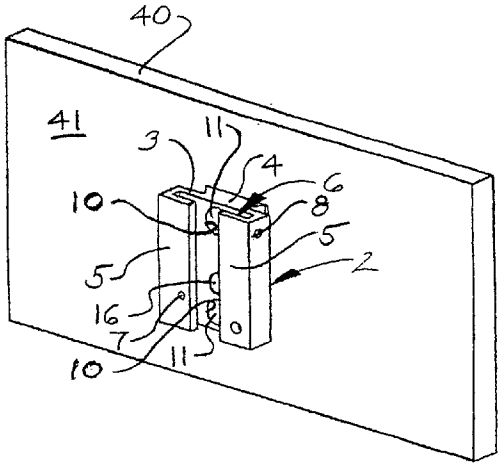
FIG. 4 is a perspective view illustrating an exemplary receiver bracket of the illustrative firearm docking system attached to the support structure.

As illustrated in FIG. 4, the firearm docking system 1 may include a receiver bracket 2 which in some applications may be provided on the mounting surface 41 of the mounting structure 40 and a male adaptor 20 (FIGS. 2 and 3) which may be provided on the firearm 34 and detachably engages the receiver bracket 2. In some applications, the receiver bracket 2 may be provided on the firearm 34 and the male adaptor 20 may be provided on the mounting structure 40. The receiver bracket 2 may include any design or structure which is suitable for detachably interfacing with the male adaptor 20. As further illustrated in FIG. 4, in some embodiments, the receiver bracket 2 may include a bracket base 3. A dovetail flange 4 may extend along a rear surface of the bracket base 3. A pair of spaced-apart bracket flanges 5 may extend from opposite edges of the bracket base 3 and in spaced-apart relationship to a front surface of the bracket base 3. A generally elongated bracket slot 6 may be formed by and between the front surface of the bracket base 3 and the bracket flanges 5, and between the bracket flanges 5. In some embodiments, a lock opening 8 may extend through one of the bracket flanges 5 and communicate with the bracket slot 6 for purposes which will be hereinafter described. The receiver bracket 2 may include metal, plastic, composite material and/or any other material which is suitable for the functional requirements of the firearm docking system 1.

The receiver bracket 2 may be configured for attachment to the mounting surface 41 of the mounting structure 40 using any attachment technique which is suitable for the purpose. In some embodiments, a pair of spaced-apart bracket fastener openings 10 may extend through the bracket base 3. A pair of bracket fasteners 11 may be extended through the respective bracket fastener openings 10 and threaded into a respective pair of fastener openings (not illustrated) in the mounting structure 40 to secure the receiver bracket 2 on the mounting surface 41.

As illustrated in the cross-sectional views of FIGS. 7, 8 and 8A, an adaptor retaining mechanism 12 may be provided in the receiver bracket 2 to facilitate selective retention of the male adaptor 20 on the firearm 34 at a selected rotational position relative to the receiver bracket 2 on the mounting structure 40 for purposes which will be hereinafter described.

The adaptor retaining mechanism 12 may have any design or structure which is suitable for the purpose. In some embodiments, the adaptor retaining mechanism 12 may include at least one ball bearing cavity 14 in the bracket base 3 of the receiver bracket 2. As illustrated in FIGS. 8 and 8A, a ball bearing 16 is provided in the ball bearing cavity 14. A ball bearing spring 17 normally engages and biases the ball bearing 16 such that the ball bearing 16 protrudes from the ball bearing cavity 14 in a retaining position, as illustrated in FIG. 8. The ball bearing 16 can be selectively pushed against the ball bearing spring 17 to a release position inside the ball bearing cavity 14, as illustrated in FIG. 8A, for purposes which will be hereinafter described.

Figure 2:
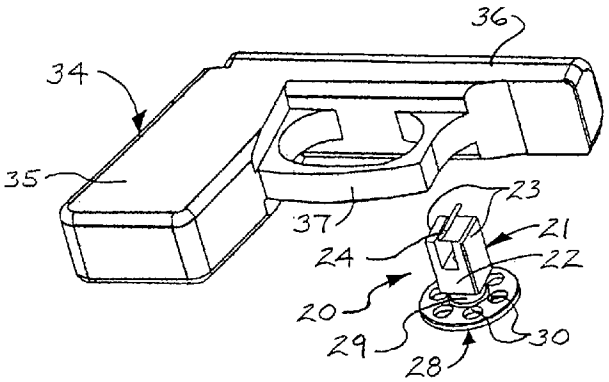
FIG. 2 is an exploded perspective view illustrating exemplary attachment of a male adaptor of the illustrative firearm docking system to the pistol.

As illustrated in FIGS. 2 and 3, the male adaptor 20 may include a male adaptor clip 21 which is adapted for attachment to the firearm 34. In some embodiments, the male adaptor clip 21 may be particularly adapted for attachment to the trigger guard 37 on the firearm 34, as illustrated. The male adaptor clip 21 may include a clip body 22. A pair of flexible or resilient, spaced-apart clip arms 23, which may be elongated, as illustrated, may extend from the clip body 22 in spaced-apart, parallel relationship to each other. A clip flange 24 may extend from one of the clip arms 23. Accordingly, the clip flange 24 can be manipulated to selectively pull the clip arms 23 away from each other and facilitate placement of the clip arms 23 around the trigger guard 37 and attachment of the male adaptor 20 to the firearm 34, as illustrated in FIG. 3.

An adaptor flange 28 which may be circular is provided on the clip body 22 of the male adaptor clip 21 of the male adaptor 20. In some embodiments, the adaptor flange 28 may be provided on an adaptor flange insert 29 which extends from the clip body 22 of the male adaptor clip 21. Multiple adaptor flange openings 30 may extend through the adaptor flange 28 in spaced-apart relationship to each other. Accordingly, as illustrated in FIG. 7, the adaptor flange 28 of the male adaptor 20 is adapted to slide into the companion bracket slot 6 of the receiver bracket 2. As illustrated in FIG. 8, the ball bearing spring 17 of the adaptor retaining mechanism 12 in the receiver bracket 2 normally engages and biases the ball bearing 16 such that the ball bearing 16 inserts or seats into one of the adaptor flange openings 30 in the adaptor flange 28 of the male adaptor 20. Thus, the ball bearing 16 normally prevents the adaptor flange 28 from inadvertently rotating relative to the receiver bracket 2 and secures the firearm 34 at a selected position or orientation relative to the mounting structure 40. The firearm 34 can be selectively rotated manually such that the adaptor flange 28 of the male adaptor 20 rotates with the firearm 34 relative to the stationary mounting structure 40. The adaptor flange 28 urges the ball bearing 16 against the bias imparted by the ball bearing spring 17, as illustrated in FIG. 8A, such that the adaptor flange 28 continues to rotate until an adjacent adaptor flange opening 30 in the adaptor flange 28 registers with the ball bearing cavity 14 and the ball bearing spring 17 snaps the ball bearing 16 into the adaptor flange opening 30, retaining the firearm 34 at the new position or orientation relative to the mounting structure 40. In a similar manner, the firearm 34 can be selectively rotated 360 degrees relative to the mounting structure 40 and parallel to the plane of the mounting surface 41 according to the positional preferences of the user of the firearm 34.

In exemplary application of the firearm docking assembly 1, the receiver bracket 2 is mounted on a selected mounting surface 41 of the mounting structure 40 typically as was heretofore described with respect to FIG. 4 to provide a user of the firearm 34 with ease and convenience in accessing and retrieving the firearm 34 from the mounting structure 40 such as for use of the firearm 34. The firearm 34 may be attached to the mounting structure 40 by inserting the adaptor flange 28 of the male adaptor 20 into the companion bracket slot 6 in the receiver bracket 2 until the ball bearing 16 of the adaptor retaining mechanism 12 (FIG. 8), protruding from the ball bearing cavity 14 in the bracket base 3 of the receiver bracket 2, snaps into an aligned or registering one of the adaptor flange openings 30 in the adaptor flange 28 under the biasing influence of the ball bearing spring 17. Therefore, the ball bearing 16 normally detains the firearm 34 in the initial orientation in which the firearm 34 was positioned as the adaptor flange 28 was inserted into the bracket slot 6. The orientation of the firearm 34 can be selectively adjusted to any position or orientation within a range of 360 degrees, according to the preferences of the user of the firearm 34, by manually rotating the firearm 34 such that the adaptor flange 28 of the male adaptor 20 rotates relative to the stationary receiver bracket 2. This rotating action of the male adaptor 20 causes the portion of the adaptor flange 28 between the adjacent adaptor flange openings 30 temporarily urges the ball bearing 16 back into the ball bearing cavity 14 in the receiver bracket 2, against the bias imparted by the ball bearing spring 17, until the next adaptor flange opening 30 in the adaptor flange 28 registers with the ball bearing cavity 14 and the ball bearing 16 snaps into the registering adjacent adaptor flange opening 30 in the adaptor flange 28. In the foregoing manner, the user of the firearm 34 can selectively position or orient the grip 35 of the firearm 34 relative to the mounting structure 40 for ease of access and retrieval when use of the firearm 34 is desired. In some embodiments, at least one flange stop pin 7 may extend through pin openings (not illustrated) in at least one of the bracket flanges 5 and the bracket base 3 of the receiver bracket 2. The flange stop in or pins 7 may stop the adaptor flange 28 in the bracket slot 6 such that the adaptor flange openings 30 in the adaptor flange 28 register with the ball bearing cavity 14 (FIGS. 8 and 8A) in the bracket base 3 of the receiver bracket 2.

The firearm 34 may be selectively removed from the receiver bracket 2 by initially applying pressure against the firearm 34 along the longitudinal axis of the bracket slot 6 until the ball bearing 16 in the ball bearing cavity 14 of the receiver bracket 2 initially disengages the registering adaptor flange opening 30 in the adaptor flange 28 on the firearm 34 and the adaptor flange 28 then slides along and exits one end of the bracket slot 6. The firearm 34 can be subsequently re-attached to the receiver bracket 2 by again inserting the adaptor flange 28 of the male adaptor 20 into the bracket slot 6 of the receiver bracket 2 and sliding the firearm 34 and male adaptor 20 along the bracket slot 6 until the ball bearing 16 of the adaptor retaining mechanism 12 again engages one of the registering adaptor flange openings 30 in the adaptor flange 28 of the male adaptor 20 and secures the orientation of the firearm 34 relative to the mounting structure 40.

Figure 10:
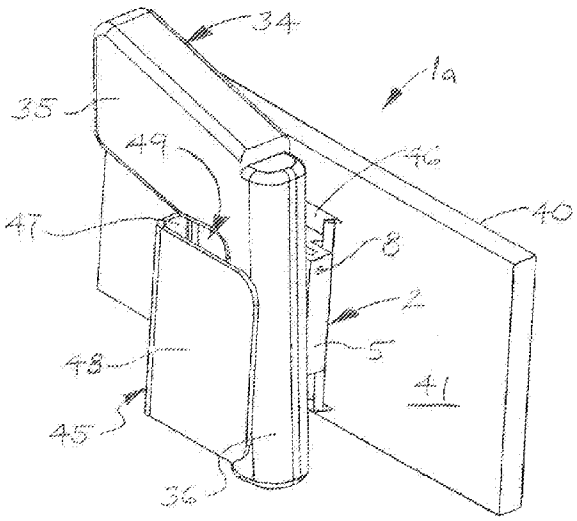
FIG. 10 is a front perspective view of the illustrative firearm docking system illustrated in FIG. 9, retrievably mounting the pistol on the support structure.
Figure 12:
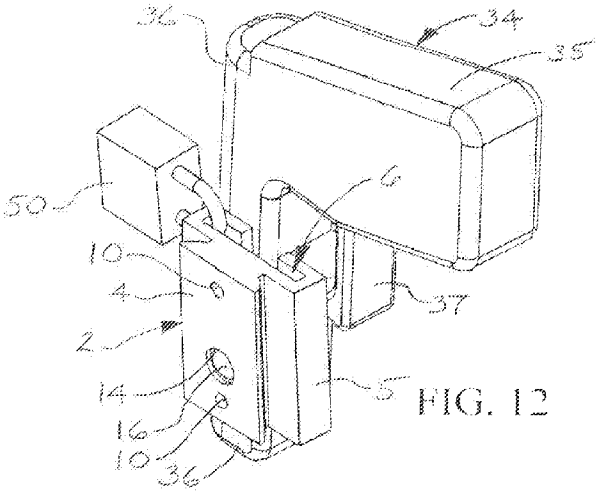
FIG. 12 is a rear perspective view of the illustrative firearm docking system illustrated in FIG. 11 with the padlock deployed in place.
Figure 9:
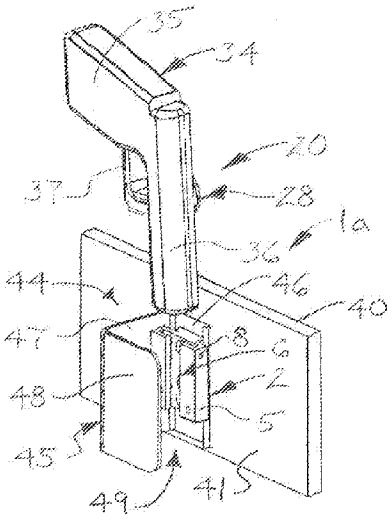
FIG. 9 is an exploded perspective view of an alternative illustrative embodiment of the firearm docking systems in retrievable mounting of a pistol on a support structure, with a firearm lock assembly for preventing trigger access.
Figure 11:
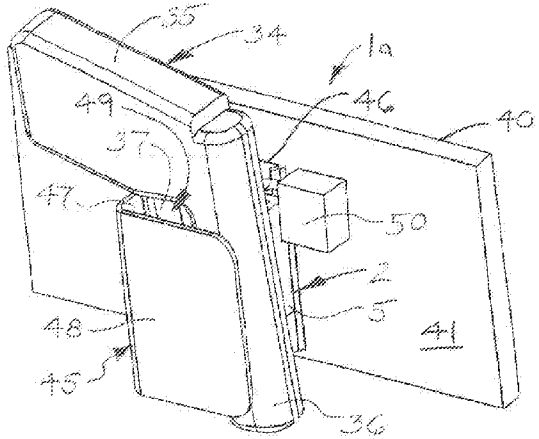
FIG. 11 is a front perspective view of the illustrative firearm docking system illustrated in FIGS. 9 and 10 with a padlock deployed in place to lock the pistol in position.

Referring next to FIGS. 9-12 of the drawings, in some embodiments, the firearm docking system 1 may include a firearm lock assembly 44 which facilitate selective locking of the firearm 34 in place on the mounting structure 40. The firearm lock assembly 44 may include a lock guard 45 which is attached to the mounting surface 41 of the mounting structure 40 and accommodates the receiver bracket 2 and the male adaptor 20 of the firearm docking system 1 to prevent unauthorized access and removal of the firearm 34. The lock guard 45 may include a lock guard base flange 46 which may be attached to the mounting surface 41 of the mounting structure 40 using mechanical fasteners (not illustrated) and/or other suitable fastening technique known by those skilled in the art. The receiver bracket 2 of the firearm docking system 1 may be attached to an interior surface of the lock guard base flange 46. A lock guard side flange 47 may extend from the lock guard base flange 46 in generally perpendicular relationship thereto. A lock guard front flange 48 may extend from the lock guard side flange 47 in generally perpendicular relationship thereto and in generally parallel relationship to the lock guard base flange 46. A lock guard interior 49 may be formed by and between the lock guard base flange 46, the lock guard side flange 47 and the lock guard front flange 48. Accordingly, when the adaptor flange 28 of the male adaptor 20 is inserted in the bracket slot 6 of the receiver bracket 2, as illustrated in FIGS. 10 and 11, the firearm 34 is disposed inside the lock guard interior 49 of the lock guard 45. A padlock 50 may be selectively extended through the lock opening 8 in one of the bracket flanges 5 of the receiver bracket 2 and locked to prevent removal of the adaptor flange 28 of the male adaptor 20 from the bracket slot 6 of the receiver bracket 2 and unauthorized removal of the firearm 34 from the lock guard interior 49 of the lock guard 45. The firearm 34 can be selectively removed from the lock guard 45 by unlocking and removing the padlock 50 to facilitate sliding and removal of the adaptor flange 28 from the bracket slot 6 of the receiver bracket 2, as was heretofore described with respect to FIGS. 1-8A.

Figure 13:
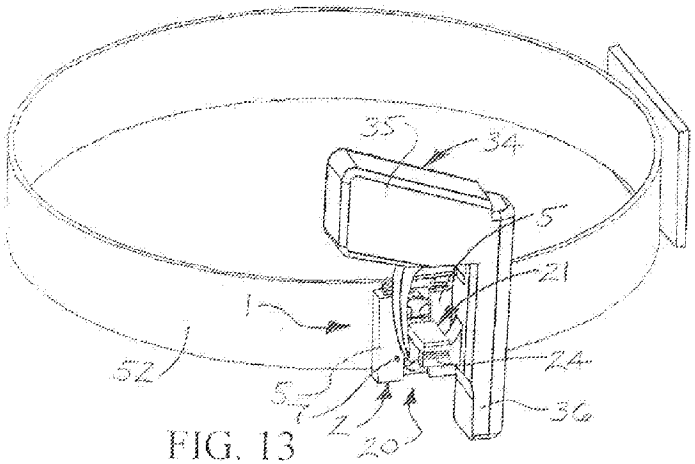
FIG. 13 is a front perspective view of an illustrative embodiment of the firearm docking system provided on a belt and retrievably mounting a pistol on the belt.
Figure 14:
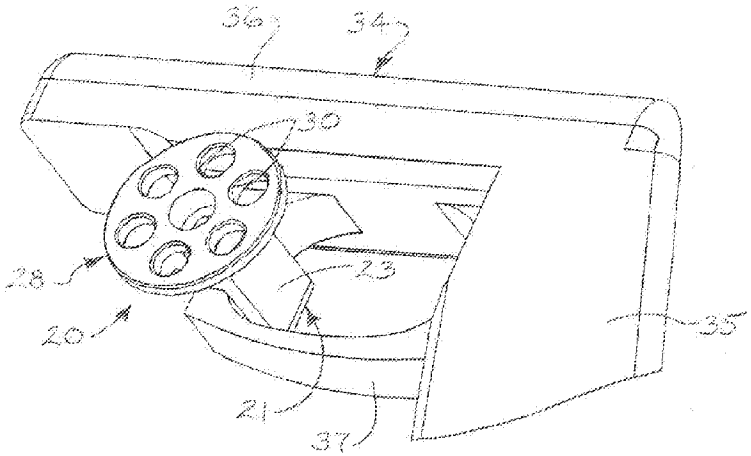
FIG. 14 is a perspective view of an exemplary male adaptor of an illustrative firearm docking system, mounted on a trigger guard of a pistol.

Referring next to FIGS. 13 and 14 of the drawings, an illustrative embodiment of the firearm docking system 1 retrievably mounts the firearm 34 on a belt 52 which is worn by a user of the firearm 34. The receiver bracket 2 of the firearm docking system 1 may be attached to an exterior surface of the belt 52 such as by using bracket fasteners 11 (FIG. 4) and/or other suitable attachment technique. The longitudinal axis of the bracket slot 6 in the receiver bracket 2 may be oriented in generally perpendicular relationship to the plane of the belt 52. Accordingly, by insertion of the adaptor flange 28 of the male adaptor 20 in the companion bracket slot 6 of the receiver bracket 2, the firearm 34 is retrievably attached to the belt 52 for ease and convenience of use by the wearer of the belt 52. It will be appreciated by those skilled in the art that the firearm 34 can be selectively rotated within a plane which is perpendicular to the plane of the belt 52 as the adaptor flange 28 of the male adaptor 20 is incrementally rotated relative to the receiver bracket 2, as was heretofore described, to selectively orient the firearm 34 360 degrees according to the preferred orientation of the firearm 34.

Figure 15:
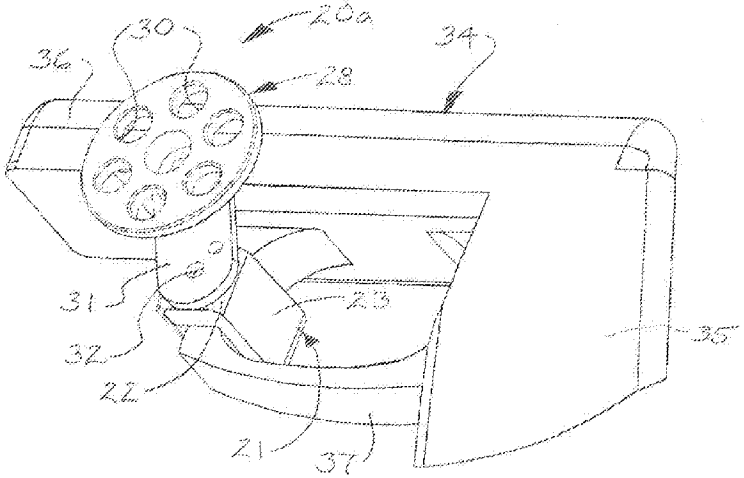
FIG. 15 is a perspective view of an alternative exemplary male adaptor with an adaptor flange positioning bracket to enhance positioning capability of the adaptor flange.
Figure 17:
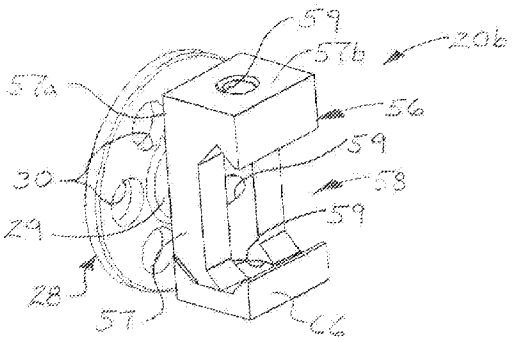
FIG. 17 is a rear perspective view of the exemplary male adaptor illustrated in FIG. 16.

Referring next to FIG. 15 of the drawings, a perspective view of an alternative exemplary male adaptor 20*a* according to an illustrative embodiment of the firearm docking system 1 is illustrated. The male adaptor 20*a* may include an adaptor flange positioning bracket 31 having a proximal end which may be pivotally attached to the clip body 22 of the male adaptor clip 21 at a bracket pivot 32. The adaptor flange 28 may be provided on a distal or extending end of the adaptor flange positioning bracket 31. Accordingly, upon insertion of the adaptor flange 28 in the bracket slot 6 (FIG. 4) of the receiver bracket 2, as was heretofore described, the adaptor flange positioning bracket 31 can be selectively pivoted relative to the male adaptor clip 21 of the male adaptor 20*a* to enhance the selective positioning capability of the firearm 34 relative to the mounting structure 40.

Referring next to FIGS. 16-18D of the drawings, an alternative exemplary male adaptor 20*b* which is suitable for engaging an accessory mount rail 38 (FIG. 18) such as a Picatinny rail or a Weaver rail, for example and without limitation, on a firearm 34 in exemplary application of an alternative illustrative embodiment of the firearm docking systems 1 is illustrated. The male adaptor 20*b* may include a rail adaptor bracket 56 which is adapted to slidably engage the accessory mount rail 38 on the firearm 34. The rail adaptor bracket 56 may include a rail adaptor bracket body 57. A racket base 66 may be provided on the rail adaptor bracket body 57. A rail slot 58 is provided in the rail adaptor bracket body 57 and the bracket base 66. The rail slot 58 is sized and configured to accommodate the accessory mount rail 38 on the firearm 34 in a sliding manner.

Figure 18:
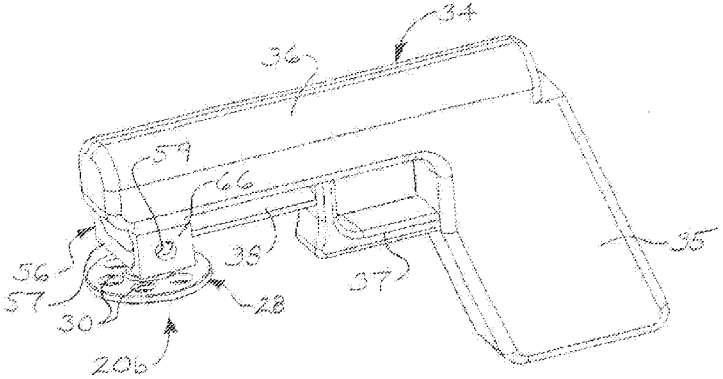
FIG. 18 is a perspective view of a pistol with the exemplary male adaptor illustrated in FIGS. 16 and 17 mounted in a bottom position on an accessory mount rail on the pistol.
Figure 18B:
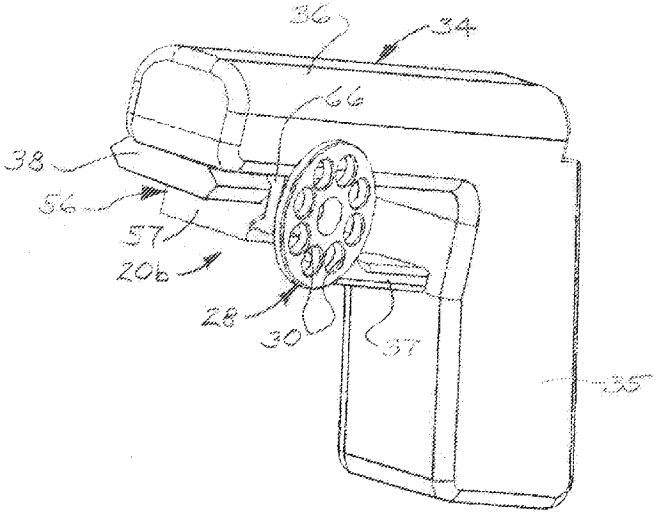
FIG. 18B is a side perspective view of a pistol with the exemplary male adaptor of FIG. 18A mounted in a side position on an accessory mount rail on the pistol.
Figure 18D:
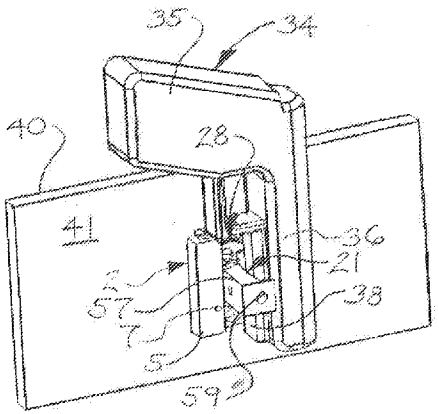
FIG. 18D is a perspective view of the pistol of FIGS. 18B and 18C mounted in place on the support structure.
Figure 18A:
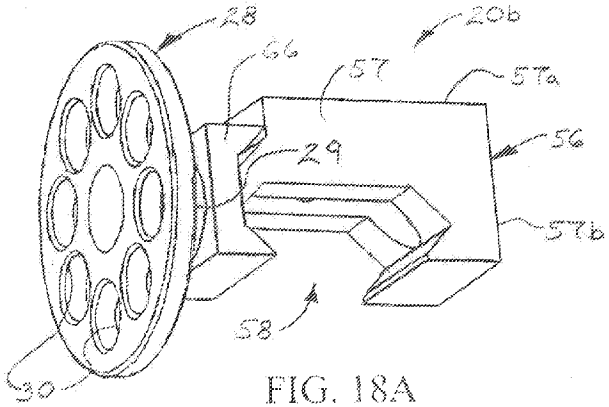
FIG. 18A is a side perspective view of an exemplary male adaptor suitable for engaging an accessory mount rail (not illustrated) on a firearm.
Figure 18C:
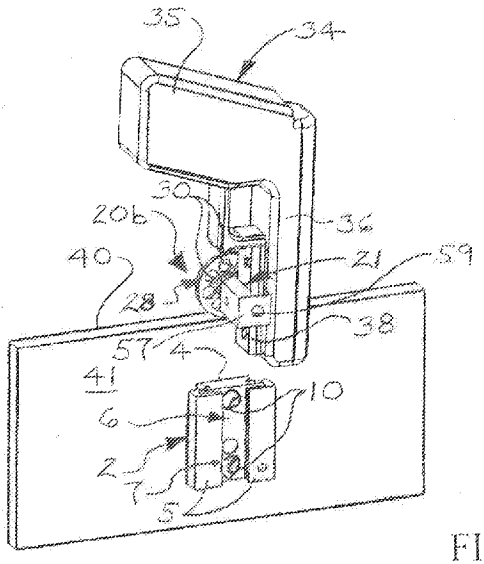
FIG. 18C is an exploded perspective view of the pistol of FIG. 18B, more particularly illustrating insertion of the male adaptor in a receiver bracket in retrievable mounting of the pistol on a support structure.

In some embodiments, the rail adaptor bracket body 57 may have a side bracket surface 57*a* and an end bracket surface 57*b*. An interiorly-threaded adaptor flange insert opening 59 may extend into each of the side bracket surface 57*a* and the end bracket surface 57*b* and communicate with the rail slot 58. An additional interiorly-threaded adaptor flange insert opening 59 may extend into the bracket base 66. An adaptor flange insert 29 on the adaptor flange 28 may be threaded into the adaptor flange insert opening 59 in the side bracket surface 57*a* or the end bracket surface 57*b* of the rail adaptor bracket body 57 or into the adaptor flange insert opening 59 in the bracket base 66 depending on the desired mounting orientation of the firearm 34 on the mounting structure 40. Accordingly, the adaptor flange insert 29 can be selectively tightened in the adaptor flange insert opening 59 against the accessory mount rail 38 to secure the rail adaptor bracket 56 at a selected position along the accessory mount rail 38. As illustrated in FIGS. 18C and 18D, in use, the adaptor flange 28 can be selectively inserted in the bracket slot 6 (FIG. 4) in the receiver bracket 2 to retrievably mount the firearm 34 on the mounting structure 40, as was heretofore described with respect to the male adaptor 20 in FIGS. 5-8A.

Referring next to FIGS. 19-22 of the drawings, retrievable mounting of a rifle 70 on a mounting structure 40 in exemplary application of an illustrative embodiment of the firearm docking systems 1 is illustrated. At least one adaptor flange 28 may be provided on the rifle 70.

Figure 19:
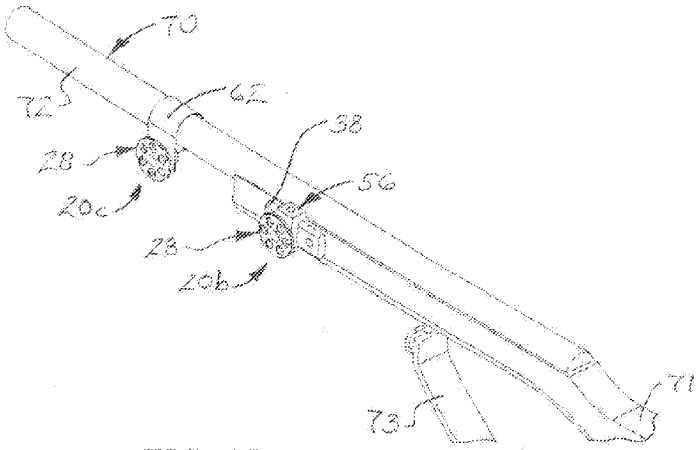
FIG. 19 is a perspective view, partially in section, of the front portion of a rifle, with a pair of male adaptors mounted on the rifle according to another illustrative embodiment of the firearm docking system.
Figure 16:
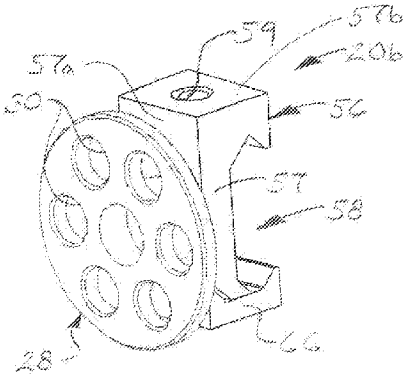
FIG. 16 is a front perspective view of an alternative exemplary male adaptor suitable for engaging an accessory mount rail (not illustrated) on a firearm.

As illustrated in FIG. 19, in some embodiments, a male adaptor 20*c* may be provided on a barrel 72 of the rifle 70. The male adaptor 20*c* may include a receiver bracket 62 which is adapted for attachment to the barrel 72 using mechanical fasteners (not illustrated) and/or other suitable attachment technique. An adaptor flange 28 may be provided on the receiver bracket 62. Additionally or alternatively, a male adaptor 20*b* may be provided on a stock 71 of the rifle 70. The male adaptor 20*b* may be adapted for attachment to an accessory mount rail 38 on the front portion of the rifle stock 71 using mechanical fasteners (not illustrated) and/or other suitable attachment technique.

Figure 21:
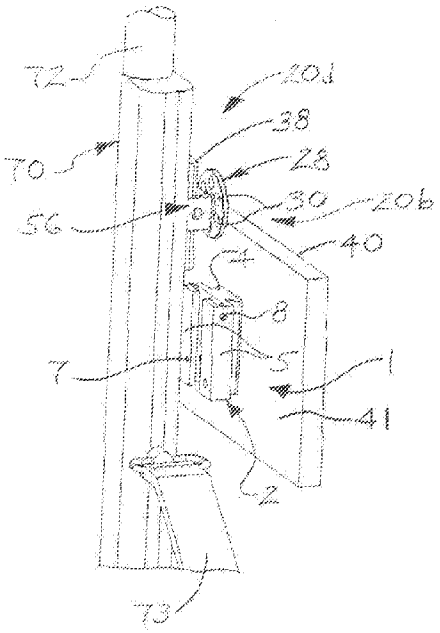
FIG. 21 is an exploded perspective view, partially in section, of the rifle illustrated in FIG. 19 in retrievable mounting of the rifle on a support structure.
Figure 22:
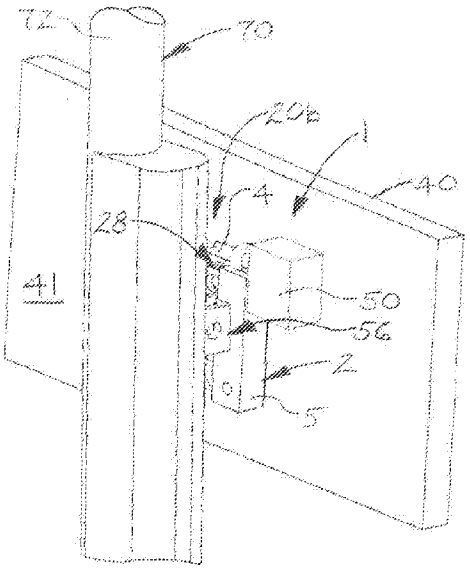
FIG. 22 is a perspective view of the illustrative firearm docking system illustrated in FIG. 21, retrievably mounting the rifle on the support structure, with a padlock locking the rifle in the system.
Figure 20:
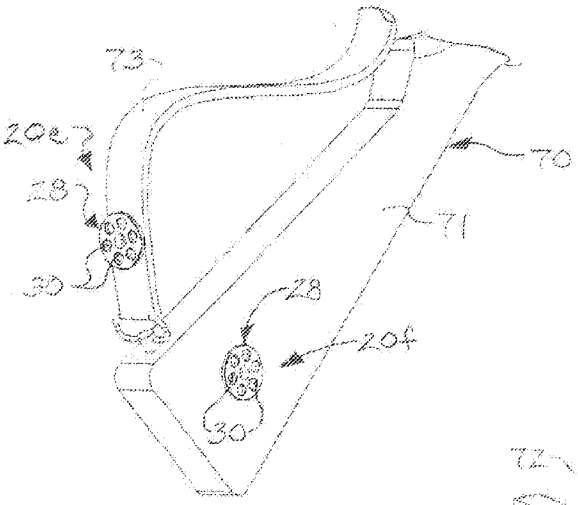
FIG. 20 is a perspective view, partially in section, of the rear portion of a rifle, with a pair of male adaptors mounted on the stock and strap, respectively, of the rifle.
Figure 24:
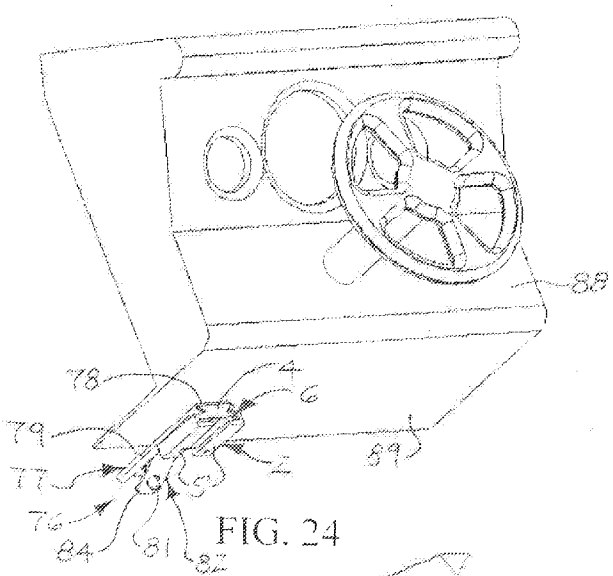
FIG. 24 is a perspective view of the illustrative firearm docking system illustrated in FIG. 23, with the pistol removed from a rail clip of the system.

As illustrated in FIGS. 21 and 22, in mounting of the rifle 70 on the mounting structure 40, the adaptor flange 28 of the male adaptor 20*c* or the adaptor flange 28 of the male adaptor 20*d* can be selectively inserted in the companion bracket slot 6 of the receiver bracket 2. As illustrated in FIG. 22, in some applications, a padlock 50 can be used to lock the adaptor flange 28 in the receiver bracket 2 as was heretofore described with respect to FIGS. 11 and 12. As illustrated in FIG. 20, in some applications, one or more additional or alternative male adaptors 20*e*, 20*f* may be provided on a rifle strap 73 and/or on the rear portion of the rifle stock 71 to facilitate mounting of the rifle 70 to the mounting structure 40 in like manner.

Referring next to FIGS. 23-28 of the drawings, another illustrative embodiment of the firearm docking systems is generally indicated by reference numeral 1*c*. In exemplary application, the firearm docking system 1*c* may be suitable to retrievably mount a firearm 34 on a vehicle dashboard 88. The firearm docking system 1*c* may include a rail clip 76 which is adapted for attachment to a dashboard panel 89 on the vehicle dashboard 88 such as in a manner which will be hereinafter described. A receiver bracket 2 may be supported by the rail clip 76.

Figure 27:
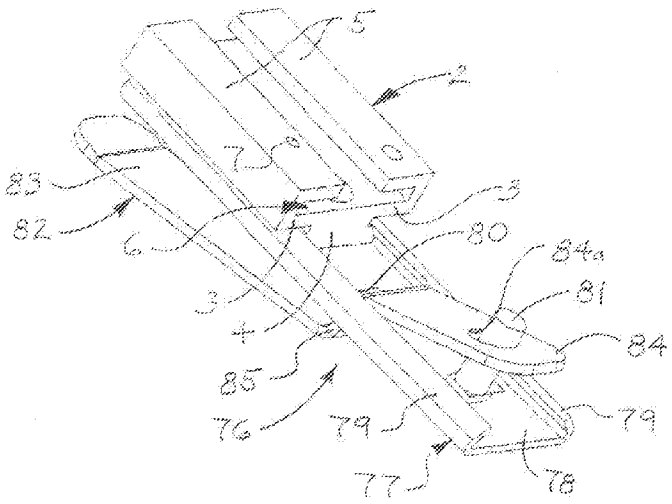
FIG. 27 is a rear perspective view of the exemplary rail clip of the illustrative firearm docking system illustrated in FIG. 23, mounted on a receiver bracket.
Figure 28:
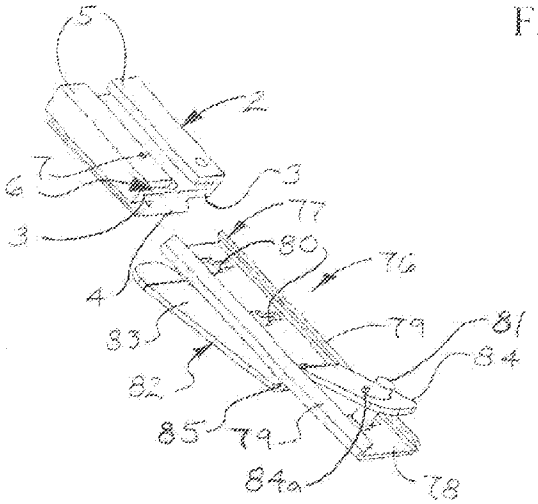
FIG. 28 is an exploded rear perspective view of the exemplary rail clip illustrated in FIG. 27, detached from the receiver bracket.
Figure 30:
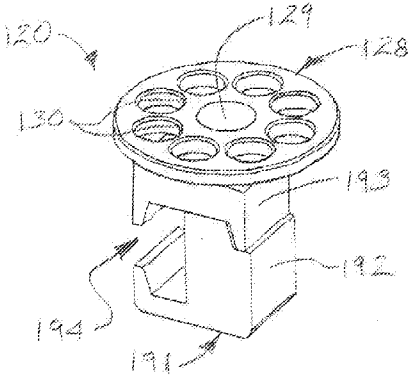
FIG. 30 is a perspective view of the exemplary male adaptor illustrated in FIG. 29.

A male adaptor 20 may be provided on the firearm 34 and slidably the receiver bracket such as was heretofore described with respect to the firearm docking system 1 in FIGS. 1-8A. As illustrated in FIGS. 27 and 28, the rail clip 76 may include a generally elongated rail 77 which may have a rail base 78 and a pair of spaced-apart rail flanges 79 which extend from opposite side edges of the rail base 78. At least one tab slot 80 may be provided in the rail base 78. A tab mount peg 81 may extend from the tab slot 80 between the rail flanges 79. As illustrated in FIG. 27, the dovetail flange 4 on the receiver bracket 2 may be adapted to slidably engage the companion rail flanges 79 on the rail 77.

A generally elongated clip tab 82 may include an engaging portion 83, an anchor portion 84 and an offset insertion portion 85 which connects the anchor portion 84 to the engaging portion 83. The insertion portion 85 may insert through a tab slot 80 in the rail base 78 of the rail 77. Accordingly, the anchor portion 84 of the clip tab 82 protrudes beyond the rail base 78 between the rail flanges 79. A peg opening 84*a* in the anchor portion 84 of the clip tab 82 may accommodate the tab mount peg 81 which extends from the rail base 78 of the rail 77.

Figure 26:
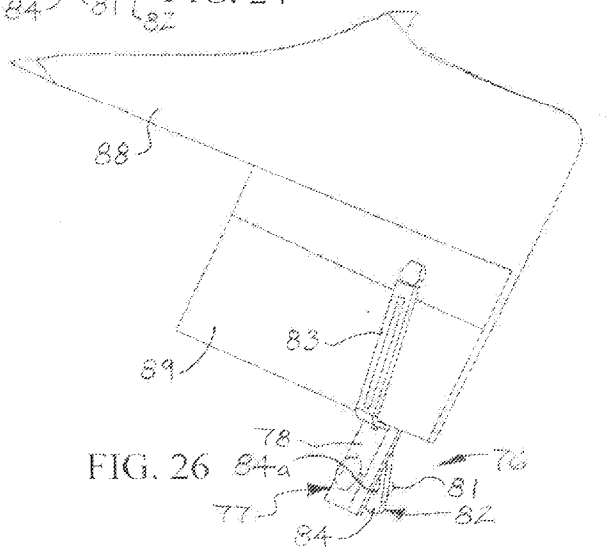
FIG. 26 is a rear perspective view of the illustrative firearm docking system illustrated in FIG. 23.
Figure 23:
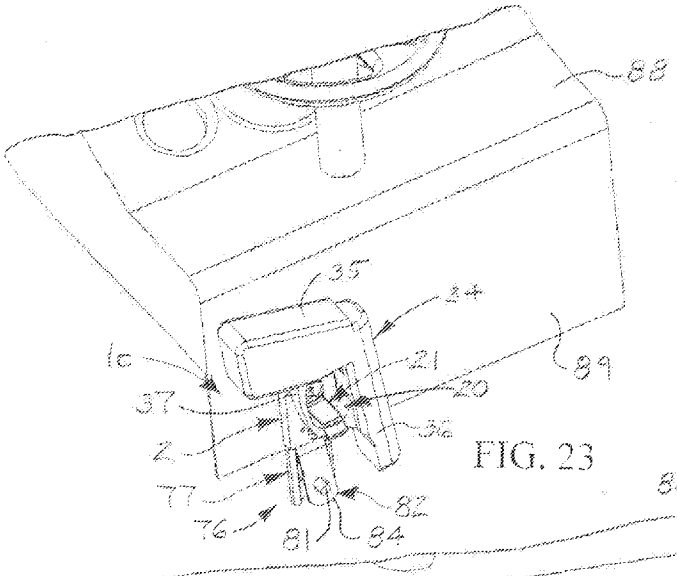
FIG. 23 is a perspective view of another illustrative embodiment of the firearm docking systems, retrievably mounting a pistol on a vehicle dashboard.
Figure 25:
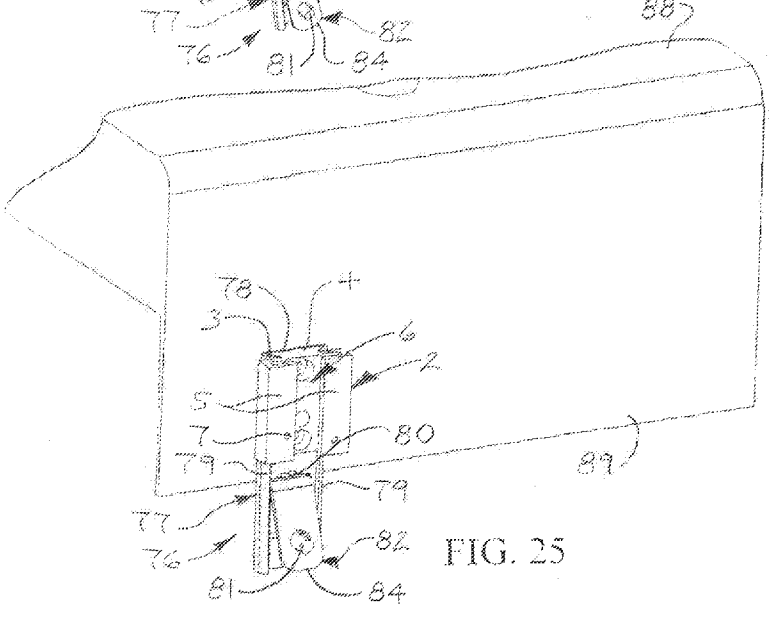
FIG. 25 is an enlarged perspective view of the illustrative firearm docking system illustrated in FIG. 23 with the pistol removed from the rail clip.
Figure 26A:
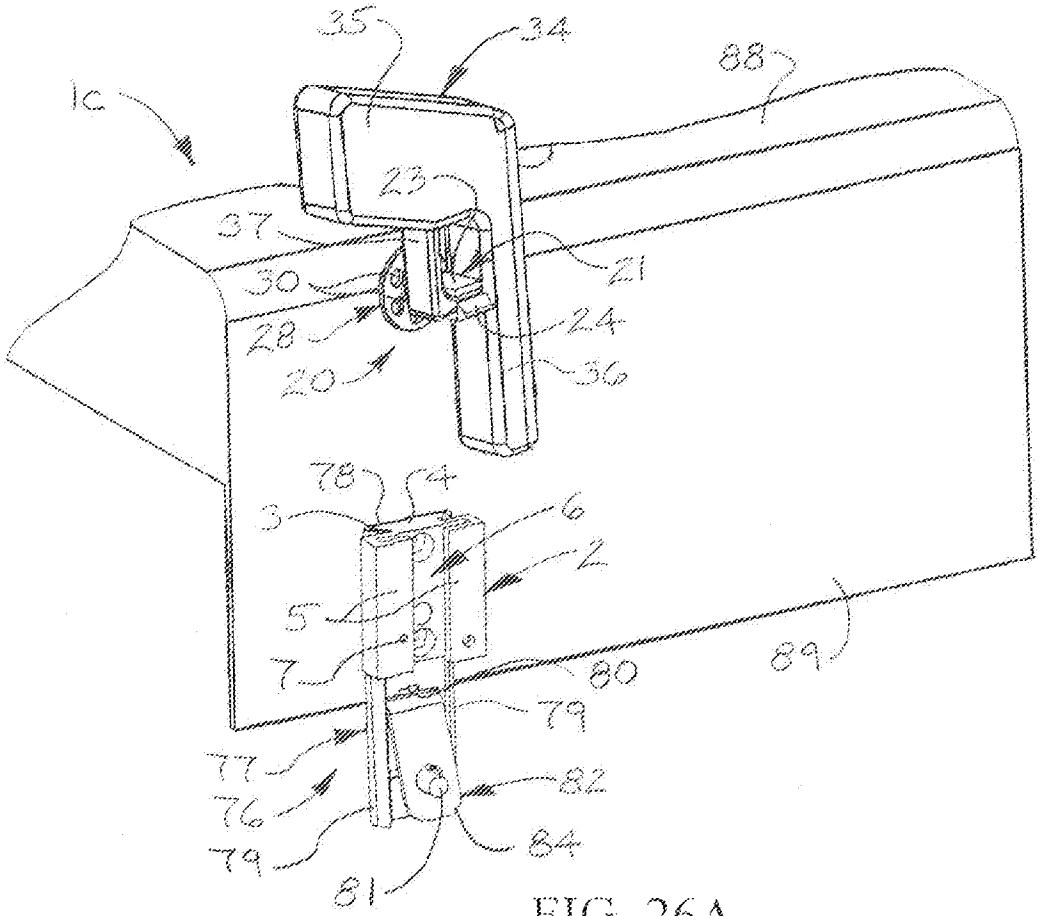
FIG. 26A is an exploded perspective view of the illustrative firearm docking system illustrated in FIG. 23 in retrievable mounting of the pistol on the vehicle dashboard.

As illustrated in FIG. 26, the rail clip 76 can be attached to the vehicle dashboard 88 by inserting the dashboard panel 89 between the engaging portion 83 and the rail 77 of the rail clip 76, with the engaging portion 83 engaging the rear surface and the rail 77 engaging the front surface of the dashboard panel 89. Accordingly, as illustrated in FIG. 25, the receiver bracket 2 is deployed in position on the dashboard panel 89 such that a user of a firearm 34 can retrievably mount the firearm 34 on the dashboard panel 89 by inserting the adaptor flange 28 (FIG. 2) of the male adaptor 20 on the firearm 34 into the companion bracket slot 6 (FIG. 24) in the receiver bracket 2, as illustrated in FIG. 26A. The rotational position of the firearm 34 relative to the dashboard panel 89 can be selectively adjusted by rotating the firearm 34 and the adaptor flange 28 relative to the receiver bracket 2, as was heretofore described. The firearm 34 can be selectively retrieved from the vehicle dashboard 88 by removing the adaptor flange 28 of the male adaptor 20 from the bracket slot 6, as was heretofore described.

Figure 29:
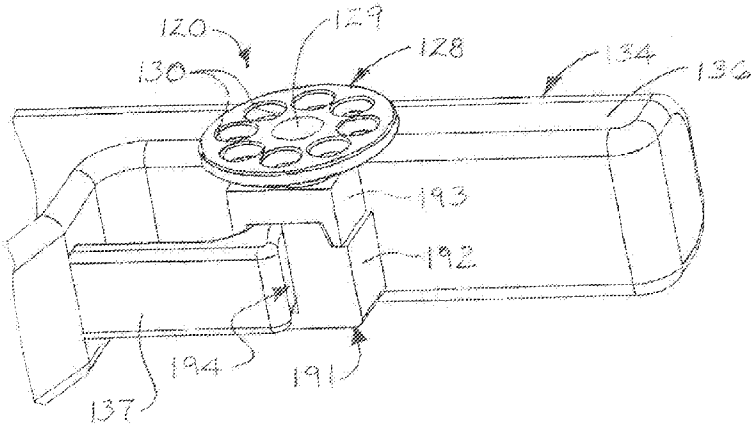
FIG. 29 is a perspective view of an exemplary male adaptor of an alternative illustrative embodiment of the firearm docking systems, provided on a trigger guard of a firearm.
Figure 32:
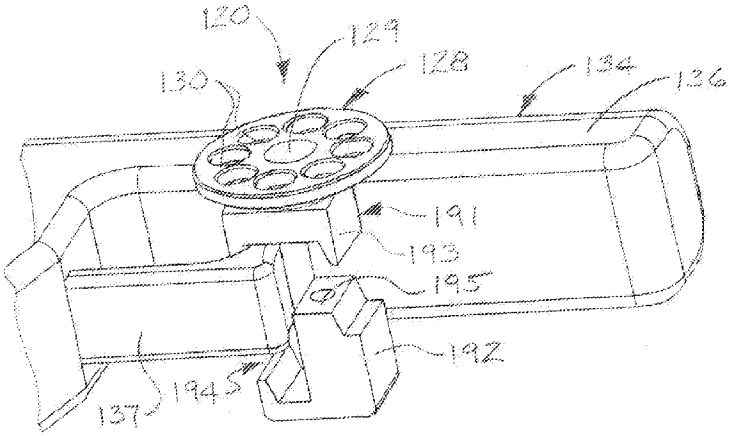
FIG. 32 is an exploded perspective view of the exemplary male adaptor, more particularly illustrating placement of the male adaptor on the trigger guard of the firearm.
Figure 31:
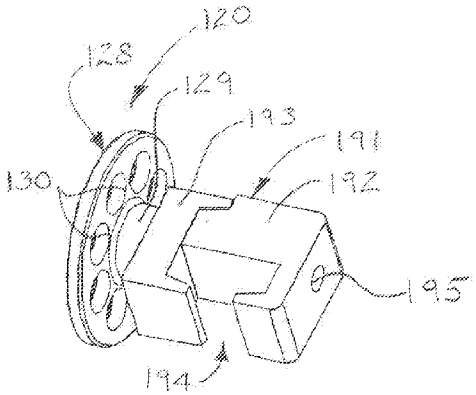
FIG. 31 is a front perspective view of the exemplary male adaptor illustrated in FIG. 29.
Figure 33:
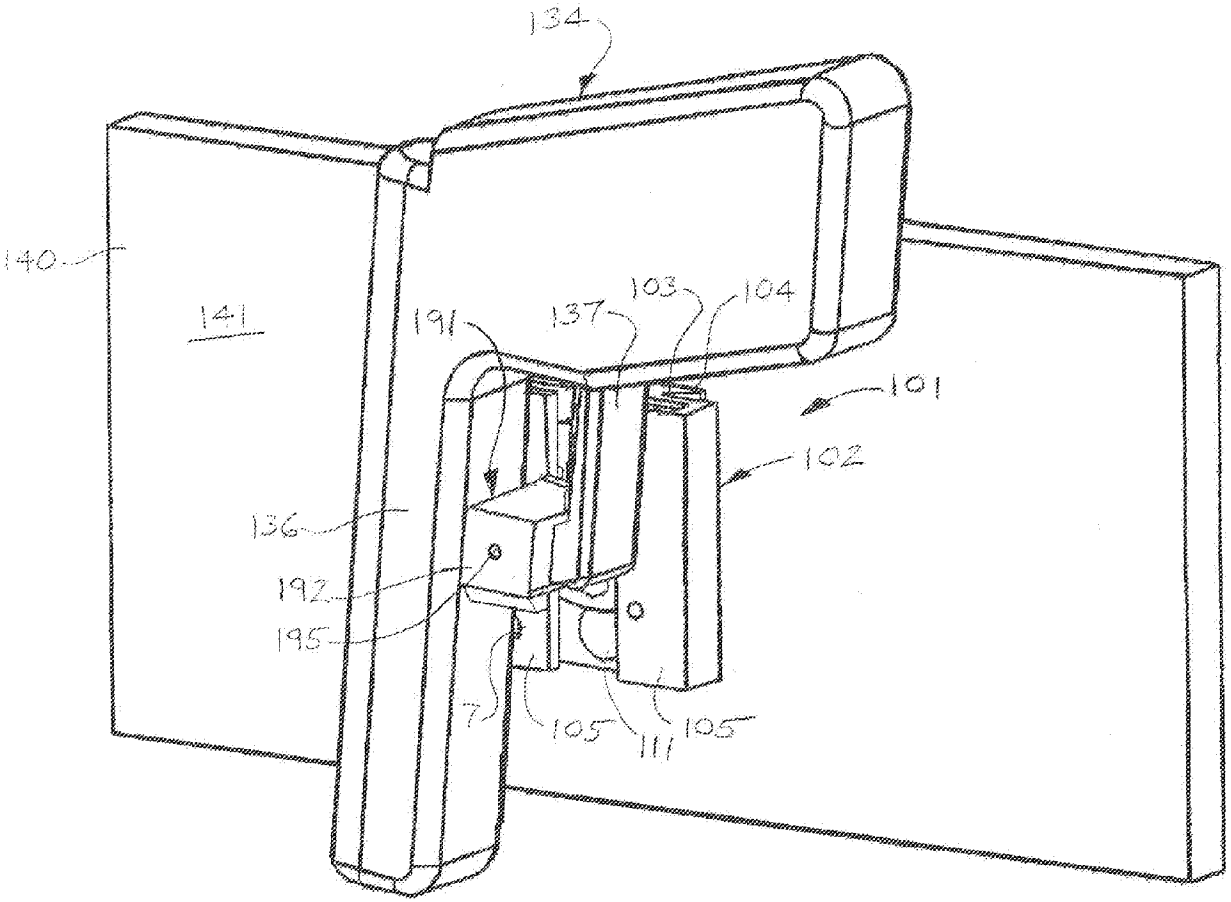
FIG. 33 is a perspective view of the illustrative firearm docking system of FIGS. 29-31 mounting a pistol in a retrievable position on a support structure.

Referring next to FIGS. 29-33 of the drawings, another alternative illustrative embodiment of the firearm docking system is generally indicated by reference numeral 101. In the firearm docking system 101, elements which are analogous to the respective elements of the firearm docking 1 that was heretofore described with respect to FIGS. 1-8B are designated by the same numeral in the 101-199 series in FIGS. 29-33. As illustrated in FIGS. 29-32, the male adaptor 120 of the firearm docking system 101 may include a male adaptor clamp 191. The male adaptor clamp 191 may include a base clamp portion 192 and a cap clamp portion 193 which detachably engages the base clamp portion 192. A clamp slot 194 may be formed upon placement of the base clamp portion 192 against the cap clamp portion 193. An adaptor flange insert opening 195 may be provided in the base clamp portion 192. Accordingly, the adaptor flange insert 129 of the adaptor flange 128 threadably engages the adaptor flange insert opening 195 to detachably secure the base clamp portion 192 to the cap clamp portion 193 of the male adaptor clamp 191. In exemplary application, the clamp slot 194 may accommodate the trigger guard 137 to secure the male adaptor clamp 191 to the trigger guard 137, as illustrated in FIGS. 29 and 32. As illustrated in FIG. 33, the firearm 134 can be selectively and retrievably attached to the mounting structure 140 by inserting the adaptor flange 128 in the bracket slot 106 of the receiver bracket 102, as was heretofore described with respect to the firearm docking system 1 in FIGS. 1-8B.

Figure 34:
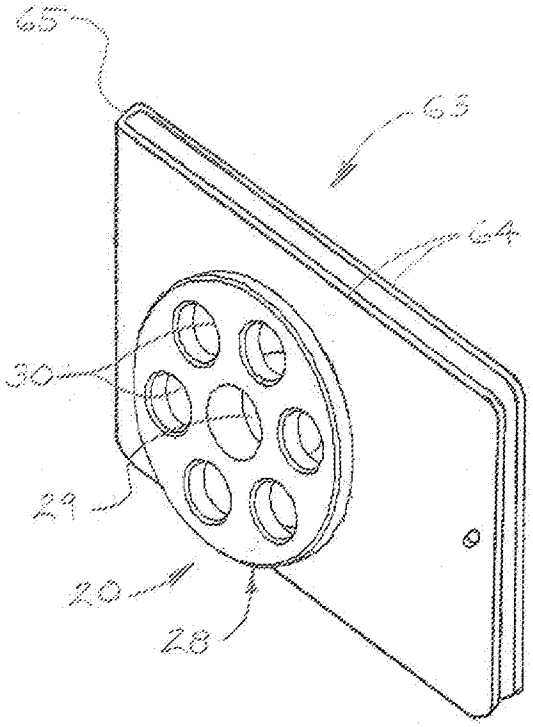
FIG. 34 is a perspective view of an exemplary holster clip with a male adaptor according to another illustrative embodiment of the firearm docking systems.

Referring next to FIG. 34 of the drawings, an exemplary holster clip 63 with a male adaptor 20 according to another illustrative embodiment of the firearm docking systems is illustrated. The holster clip 63 may include a pair of spaced-apart, parallel holster clip flanges 64 connected by a flange connecting portion 65. A male adaptor 20 may be attached to one of the holster clip flanges 64. Accordingly, the holster clip 63 can be placed on a holster (not illustrated) by inserting the holster clip flanges 64 on opposite sides of a belt loop (not illustrated) on the holster. The holster with the firearm (not illustrated) contained therein can be attached to a receiver bracket 2 (FIG. 4) on a mounting structure 40 to facilitate selective removal of the holster with the firearm contained therein from the mounting structure 40.

While illustrative embodiments of the disclosure have been described above, it will be recognized and understood that various modifications can be made to the illustrative embodiments and the appended claims are intended to cover all such modifications which may fall within the spirit and scope of the disclosure.

What is claimed is:

1. A firearm docking system, comprising:
- a receiver bracket;
- a bracket slot in the receiver bracket;
- an adaptor retaining mechanism carried by the receiver bracket adjacent to the bracket slot; and
- a male adaptor including:
  - an adaptor flange inserted in the bracket slot, the adaptor flange selectively rotatable in the bracket slot;
  - a plurality of adaptor flange openings in the adaptor flange, the adaptor retaining mechanism releasably engaging at least one of the plurality of adaptor flange openings;
- wherein the receiver bracket comprises a bracket base and a pair of spaced-apart bracket flanges carried by the bracket base, and wherein the bracket slot is formed by and between the bracket flanges; and
- a lock opening in at least one of the bracket flanges.

2. The firearm docking system of claim 1 further comprising a dovetail flange carried by the bracket base.

3. A firearm docking system, comprising:
- a receiver bracket;
- a bracket slot in the receiver bracket;
- an adaptor retaining mechanism carried by the receiver bracket adjacent to the bracket slot; and
- a male adaptor including:
  - a male adaptor clip;
  - an adaptor flange carried by the male adaptor clip and inserted in the bracket slot, the adaptor flange selectively rotatable in the bracket slot; and
  - a plurality of adaptor flange openings in the adaptor flange, the adaptor retaining mechanism releasably engaging at least one of the plurality of adaptor flange openings.

4. The firearm docking system of claim 3 wherein the male adaptor clip comprises a clip body, a pair of spaced-apart clip arms carried by the clip body and a clip flange carried by one of the clip arms.

5. The firearm docking system of claim 4 further comprising an adaptor flange insert carried by the clip body, and wherein the clip flange is carried by the adaptor flange insert.

6. A firearm docking system, comprising:
- a receiver bracket;
- a bracket slot in the receiver bracket;

an adaptor retaining mechanism carried by the receiver bracket adjacent to the bracket slot;

a male adaptor including:

an adaptor flange inserted in the bracket slot, the adaptor flange selectively rotatable in the bracket slot; and a plurality of adaptor flange openings in the adaptor flange, the adaptor retaining mechanism releasably engaging at least one of the plurality of adaptor flange openings; and a firearm lock assembly having a lock guard with a lock guard interior, and wherein the receiver bracket and the male adaptor are disposed inside the lock guard interior.

7. A firearm docking system, comprising:

a receiver bracket;

a bracket slot in the receiver bracket;

an adaptor retaining mechanism carried by the receiver bracket adjacent to the bracket slot, the adaptor retaining mechanism including:

a ball bearing cavity in the receiver bracket;

a ball bearing in the ball bearing cavity; and a ball bearing spring in the ball bearing cavity, the ball bearing spring normally biasing the ball bearing in a retaining position; and a male adaptor including:

an adaptor flange inserted in the bracket slot, the adaptor flange selectively rotatable in the bracket slot; and a plurality of adaptor flange openings in the adaptor flange, the adaptor retaining mechanism releasably engaging at least one of the plurality of adaptor flange openings.

8. The firearm docking system of claim 7 wherein the receiver bracket comprises a bracket base and a pair of spaced-apart bracket flanges carried by the bracket base, and wherein the bracket slot is formed by and between the bracket flanges.

9. The firearm docking system of claim 8 further comprising a dovetail flange carried by the bracket base.

10. The firearm docking system of claim 8 further comprising a lock opening in at least one of the bracket flanges.

11. The firearm docking system of claim 7 wherein the male adaptor comprises a male adaptor clip, and wherein the adaptor flange is carried by the male adaptor clip.

12. The firearm docking system of claim 11 wherein the male adaptor clip comprises a clip body, a pair of spaced-apart clip arms carried by the clip body and a clip flange carried by one of the clip arms.

13. The firearm docking system of claim 12 further comprising an adaptor flange insert carried by the clip body, and wherein the clip flange is carried by the adaptor flange insert.

14. The firearm docking system of claim 7 further comprising a firearm lock assembly having a lock guard with a lock guard interior, and wherein the receiver bracket and the male adaptor are disposed inside the lock guard interior.

15. A firearm docking system, comprising:

a receiver bracket;

a bracket slot in the receiver bracket;

an adaptor retaining mechanism carried by the receiver bracket adjacent to the bracket slot. the adaptor retaining mechanism including:

a ball bearing cavity in the receiver bracket;

a ball bearing in the ball bearing cavity; and a ball bearing spring in the ball bearing cavity, the ball bearing spring normally biasing the ball bearing in a retaining position; and a male adaptor including:

a male adaptor clamp having a base clamp portion, a cap clamp portion detachably engaging the base clamp portion, a clamp slot formed by and between the base clamp portion and the cap clamp portion and an adaptor flange insert opening in the base clamp portion;

an adaptor flange insert carried by the cap clamp portion and threaded in the adaptor flange insert opening in the base clamp portion;

an adaptor flange carried by the adaptor flange insert and inserted in the bracket slot, the adaptor flange selectively rotatable in the bracket slot in the receiver bracket; and a plurality of adaptor flange openings in the adaptor flange, the adaptor retaining mechanism releasably engaging at least one of the plurality of adaptor flange openings.

16. The firearm docking system of claim 15 wherein the receiver bracket comprises a bracket base and a pair of spaced-apart bracket flanges carried by the bracket base, and wherein the bracket slot is formed by and between the bracket flanges.

17. The firearm docking system of claim 16 further comprising a dovetail flange carried by the bracket base.

18. The firearm docking system of claim 16 further comprising a lock opening in at least one of the bracket flanges.

* * * * *